United States Patent [19]

Brozenick

[11] 4,104,042

[45] Aug. 1, 1978

[54] MULTI-STORIED ELECTROSTATIC PRECIPITATOR

[75] Inventor: Nicholas J. Brozenick, Clarksville, Ind.

[73] Assignee: American Air Filter Company, Inc., Louisville, Ky.

[21] Appl. No.: 792,240

[22] Filed: Apr. 29, 1977

[51] Int. Cl.[2] ..... B03C 3/82

[52] U.S. Cl. ..... 55/101; 52/638

[58] Field of Search ..... 55/101, 358; 165/81, 165/82; 52/573, 637, 638; 202/268

[56] References Cited

U.S. PATENT DOCUMENTS

| | | | |
|---|---|---|---|
| 2,812,293 | 11/1957 | Vanackeren | 202/268 |
| 3,183,626 | 5/1965 | Schmitt | 52/573 |
| 3,484,800 | 12/1969 | Lange et al. | 55/358 |
| 3,921,240 | 11/1975 | Fyfe | 52/573 |
| 3,978,633 | 9/1976 | Scheidler et al. | 52/573 |

FOREIGN PATENT DOCUMENTS

| | | | |
|---|---|---|---|
| 22,800 | 7/1970 | Japan | 55/112 |
| 74,397 | 11/1971 | Netherlands | 202/268 |
| 1,079,682 | 8/1967 | United Kingdom | 165/82 |

*Primary Examiner*—Frank W. Lutter
*Assistant Examiner*—David L. Lacey

[57] ABSTRACT

A multi-storied electrostatic precipitator having a plurality of electrostatic precipitators centrally anchored in a vertical alignment stacked upon each other with sliding joints disposed therebetween, the sliding joints permitting horizontal movement between adjacent electrostatic precipitators.

2 Claims, 9 Drawing Figures

MULTI-STORIED ELECTROSTATIC PRECIPITATOR

BACKGROUND OF THE INVENTION

1. Field of the Invention

The invention relates to multi-storied electrostatic precipitators. In one aspect it relates to stacking of electrostatic precipitators in a vertical alignment, one upon the other. In another aspect the invention relates to a means for providing independent horizontal movement between adjacent vertically stacked electrostatic precipitators.

2. Description of the Prior Art

In large air filtration systems utilizing electrostatic precipitators, it has become common place to use a plurality of electrostatic precipitators in series. In many installations the electrostatic precipitators are placed adjacent to each other in a horizontal alignment but in other installations it has become necessary because of space to place the precipitators one on top of the other. In these installations where electrostatic precipitators are placed vertically, separate support systems have been devised for each individual precipitator, the supports extending downwardly and straddling the electrostatic precipitators which are disposed vertically beneath. This type of support mechanism has proved to be extremely expensive.

SUMMARY OF THE INVENTION

In the present invention, it is recognized that it is desirable to provide a plurality of electrostatic precipitators which are stacked one on top of the other. Furthermore, it is recognized that it is desirable to provide a support means for a plurality of electrostatic precipitators stacked one on top of the other utilizing the lower electrostatic precipitators to support the precipitators disposed thereabove. Even further, it is recognized that it is desirable to provide support means for vertically stacked electrostatic precipitators which allows for movement in a horizontal direction between adjacent precipitators.

The present invention advantageously provides a straightforward arrangement for the stacking of electrostatic precipitators in a vertical alignment wherein the lower precipitators support the precipitators which are disposed thereabove and also provides means allowing for horizontal movement between adjacent electrostatic precipitators with the supports therebetween being stationary.

Various other features of the present invention will become obvious to those skilled in the art upon reading the disclosure set forth hereinafter.

More particularly, the present invention provides a multi-storied electrostatic precipitator comprising: a base support; a first electrostatic precipitator mounted onto the base support with first horizontal sliding means disposed therebetween; an intermediate support mounted onto the first electrostatic precipitator with second horizontal sliding means disposed therebetween; and, a second electrostatic precipitator mounted onto the intermediate support with third horizontal sliding means disposed therebetween whereby said first and second electrostatic precipitators are movable in a horizontal direction independent of each other.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
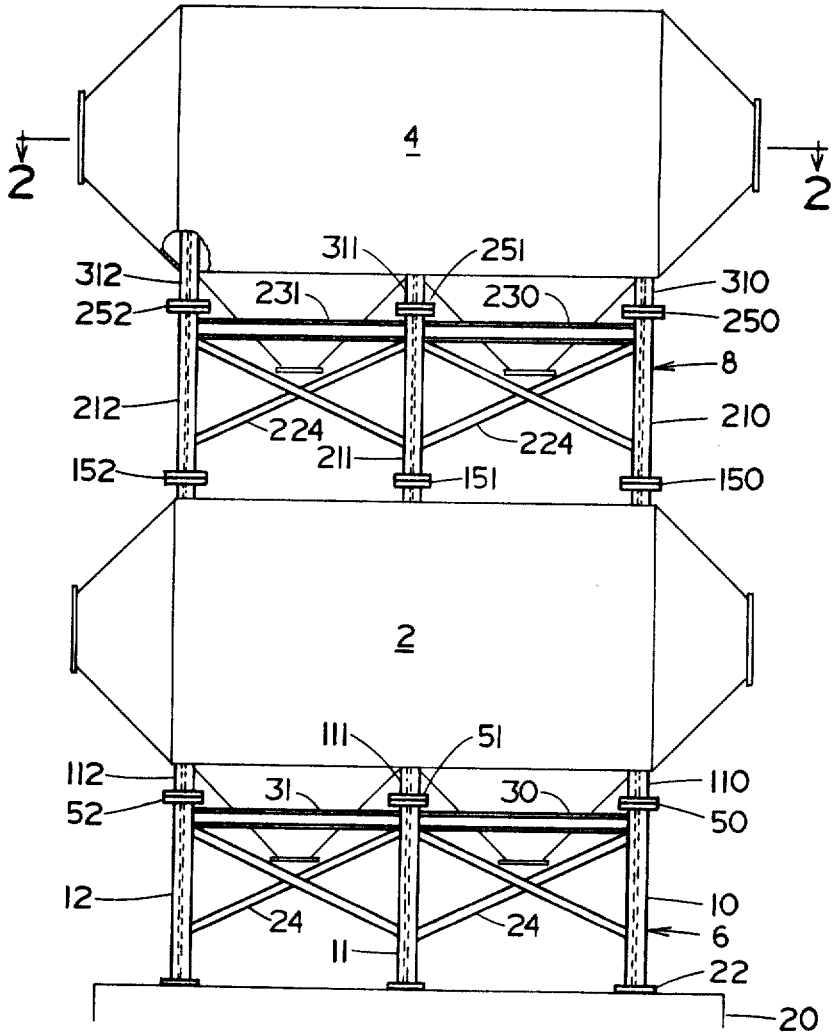
FIG. 1 is an elevational view of an apparatus in accordance with the present invention.
Figure 3:
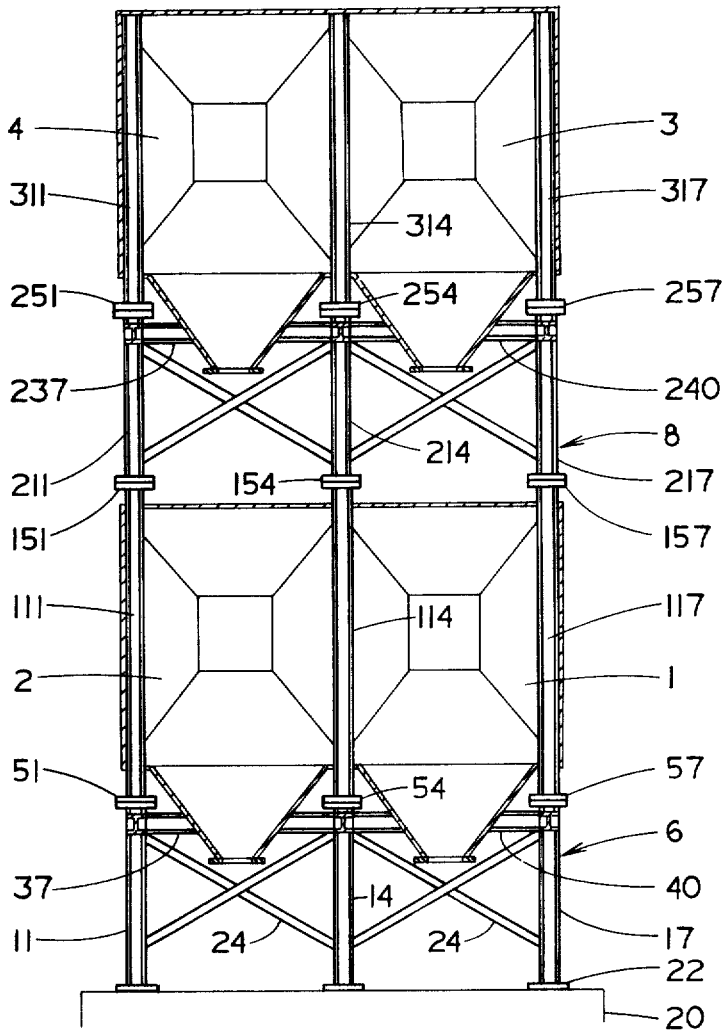
FIG. 3 is a cross-sectional view taken in a plane passing through line 3—3 of FIG. 2.

FIGS. 1 and 3 of the drawing illustrates a structure of a plurality of electrostatic precipitators 1, 2, 3 and 4 stacked upon each other with a base support system 6 supporting the entire structure and an intermediate support system 8 mounted to support precipitators 3 and 4. The electrostatic precipitators are mounted with means permitting expansion and contraction (hereinafter described) with the support systems 6 and 8 (hereinafter described) remaining stationary.

The support system 6 includes a plurality of vertically extending support members, only five being shown and identified by numerals 10, 11, 12, 14 and 17. It is realized that four more vertical members (not shown) spaced in alignment with the five mentioned previously are also provided for in the support system 6. For a better appreciation of the support system 6, reference is made to the support system shown in FIG. 2 and described hereinafter, which includes the horizontal support system 8 which is identical, for illustrative purposes, to the horizontal support members in support system 6.

The vertically extending members are fastened to a concrete slab 20 by welding of flat plates 22 to the bottom of the members and passing appropriate bolting means (not shown) therethrough. A plurality of cross-members 24 are spaced at preselected positions to reinforce the vertical members. Furthermore, twelve horizontally extending I-beam brace members, only four being shown, identifiable by numerals 30, 31, 37, and 40, the other eight being aligned in the same manner as the support system shown in FIG. 2 and described hereinafter are connected to the upper ends of the nine vertically extending members, only members 10, 11, 12, 14 and 17 being shown, to further support the vertical members.

Figure 5:
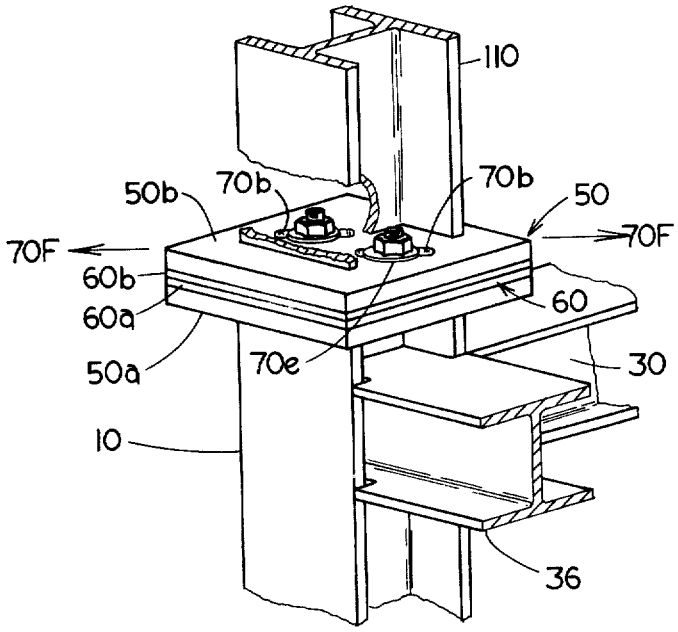
FIG. 5 is an enlarged isometric view of one corner sliding connection assembly shown in FIGS. 1 and 2.
Figure 6:
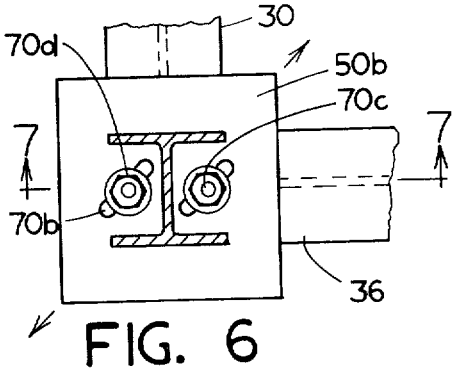
FIG. 6 is a plan view of FIG. 5.
Figure 7:
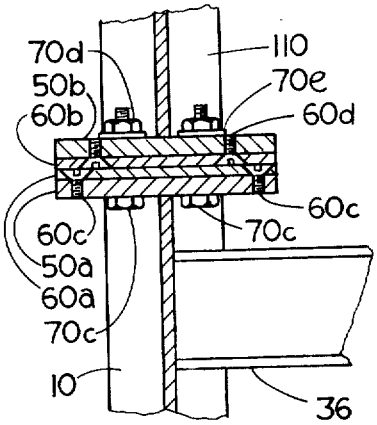
FIG. 7 is a cross-sectional view taken in a plane passing through line 7—7 of FIG. 6.
Figure 8:
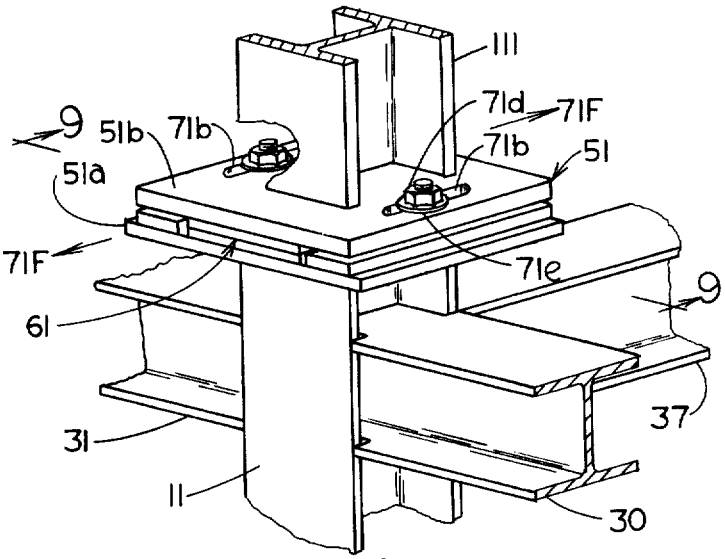
FIG. 8 is an enlarged isometric view of one intermediate sliding connection assembly shown in FIGS. 1, 2 and 3; and, FIG. 9 is a cross-sectional view taken in a plane passing through line 9—9 of FIG. 8.
Figure 9:
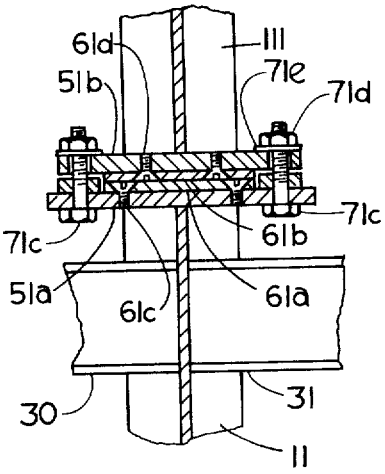

Each of the vertically extending members of support system 6 are attached at their upper ends to the lower ends of vertically aligned vertically extending members, only five being shown and identified by numerals 110, 111, 112, 114 and 117. It is again realized that four more vertical members (not shown) spaced in alignment with the five mentioned previously are also provided. With the exception of the connection assembly 54 between members 14 and 114 wherein the members are fixedly attached (FIG. 4), the remainder of the connection assemblies between the vertical members includes means for sliding attachment (FIGS. 5–9) between the members. At the connection between vertical members at the corners, such as connection assembly 50 for members 10–110 and connection assembly 52 for members 12–112; FIGS. 5, 6 and 7 show one preferred sliding attaching means whereas at the connection between intermediate vertical members, such as connection assembly 51 for members 11–111 and connection assembly 57 for members 17–117, FIGS. 8 and 9 show one preferred sliding attachment means.

Figure 2:
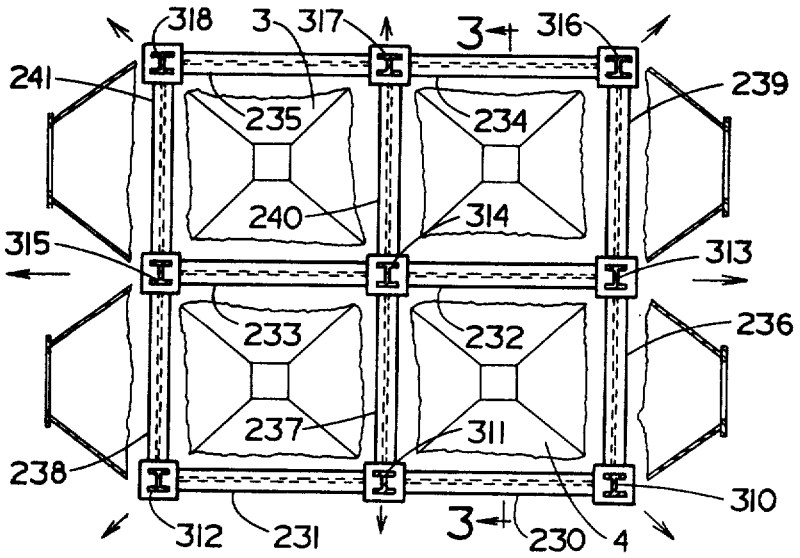
FIG. 2 is a cross-sectional view taken in a plane passing through line 2—2 of FIG. 1.
Figure 4:
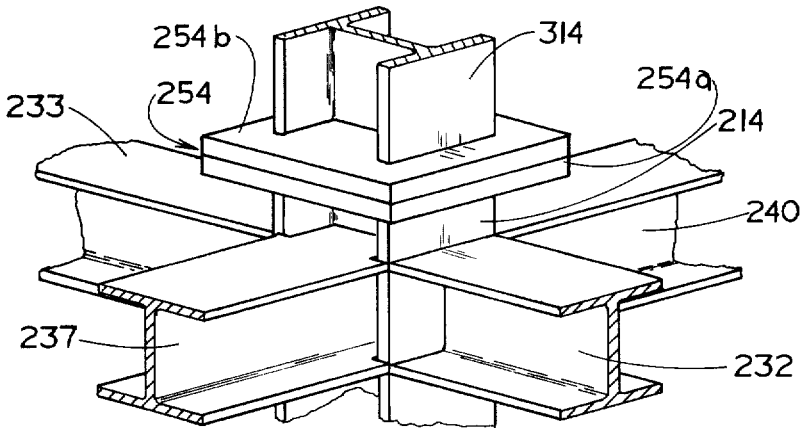
FIG. 4 is an enlarged isometric view of one connection assembly of the stationary center column shown in FIG. 3.

In FIG. 4, connection assembly 254 includes a pair of flat plate memers 254*a* and 254*b* which are welded on one face to members 214 and 314, respectively, and on their opposed faces to each other. It is realized that plates 254*a* and 254*b* may be fixedly attached by other well known means, such as bolt members which extend through aligned apertures in the plates. Furthermore, connection assemblies 54 and 154 (FIG. 3) are identical in structure to connection assembly 254 and will therefore not be discussed in detail. Thus, this center column formed by vertical support members 14, 114, 214 and 314 is rigidly attached and does not move upon expansion and contraction of the electrostatic precipitators 1, 2, 3, and 4. It is also shown that horizontally extending beam support members 232, 233, 237 and 240 are welded at one end to member 214 and attached at their opposed ends to vertically extending intermediate support members 211 and 217 (FIG. 3) and vertically extending intermediate beam members disposed in the column directly beneath support members 315 and 313 (FIG. 2). FIG. 2 shows a typical arrangement of the horizontal support structure for the horizontal beam members shown by numerals 230–241, it being realized that the same horizontal structure is applicable to the horizontal structure including horizontal beam members 30, 31, 37 and 40. Thus, vertically extending members 10, 11, 12, 14 and 17 (FIGS. 1 and 3) as well as appropriately aligned members in support system i.e., which are in vertical alignment with members 313, 315, 316 and 318 are stationary in a horizontal plane and vertically extending members 210, 211, 212, 214 and 217 (FIGS. 1 and 3) as well as appropriately aligned members support system 8 which are in vertical alignment with members 313, 315, 316 and 318 are also stationary in a horizontal plane.

In FIGS. 5, 6 and 7, connection assembly 50 includes a pair of plate members 50*a* and 50*b* with a sliding connection assembly 60 disposed therebetween. Plate member 50*a* is a cap plate welded on one face thereof to the vertical member 10 and the opposite face of cap plate 50*a* is bolted to a slide pad 60*a* by a plurality of bolts 60*c* (FIG. 7). Slide pad 60*a* is generally a stainless steel flat plate with a lubricated surface on the face thereof in contact with a slide pad 60*b*, slide pad 60*b* also being generally a stainless steel plate bolted to plate member 50*b* by a plurality of bolts 60*d*.

Slide pad 60*b* and plate member 50*b* are provided with aligned elongated slotted apertures, only apertures 70*b* in plate 50*b* being shown. Slide pad 60*a* and plate member 50*a* are provided with aligned apertures (not shown) therein of sufficient diameter to receive bolts 70*c* therethrough, bolts 70*c* having nuts 70*d* thereon with a washer 70*e* disposed between nut 70*d* and plate 50*b*. Washer 70*e* has a flat face thereon with edges extending beyond the edges of slot 70*b* to permit movement of plate 50*b* and pad 60*b* relative to the plate 50*a* and pad 60*a*. It is specifically noted that slots 70*b* are in parallel with each other and line 70*f* which is a plane running through opposed corners of plate 50*b*. Slot 70*b* disposed in this manner permits for angular movement of the vertical member 110 upon expansion and contraction of precipitators 1 and 2.

In describing the connection assembly 50, it is realized that all corner connection assemblies, including connection assemblies 52, 150, 152, 250, 252 which are shown as well as those that are not shown, are identical in structure thereby permitting angular expansion and contraction of the precipitators 1, 2, 3 and 4. Therefore, further discussion of the aforementioned connection assemblies in detail will not be made.

It is also shown that horizontally extending support member 30 is welded at one end to member 10 and attached at its opposite end to vertically extending intermediate beam members 11 (FIG. 1) and another horizontally extending support member is welded at one end to member 10 and attached at its other end to the vertically extending intermediate beam member disposed in the vertical column directly beneath beam member 313 (FIG. 2). As discussed previously, the horizontal support structure of base support system 6 and intermediate support system 8 maintain the vertical extending members in the support systems stationary.

In FIGS. 8 and 9, connection assembly 51 includes a pair of plate members 51, 51*a* and 51*b* with a sliding connection assembly 61 disposed therebetween. Plate member 51*a* is a cap plate welded on one face thereof to the vertical member 11 and the opposite face of cap plate 51*a* is bolted to a slide pad 61*a* by a plurality of bolts 61*c* (FIG. 9). Slide pad 61*a* is generally a stainless steel flat plate with a lubricated surface on the face in contact with a slide pad 61*b*, slide pad 61*b* also being generally a stainless steel plate bolted to plate member 51*b* by a plurality of bolts 61*d*.

Slide plate member 51*b* is provided with elongated slotted apertures 71*b* therein in alignment with apertures (not shown) in slide pad 61*a* and plate member 51*a* which are of sufficient diameter to receive bolts 71*c* therethrough, bolts 71*c* having nuts 71*d* thereon with a washer 71*e* disposed between nut 71*d* and plate 51*b*. Washer 71*e* has a flat face thereon with edges extending beyond the edges of slot 71*b* to permit movement of plate 51*b* and pad 61*b* relative to the plate 51*a* and pad 61*a*. It is specifically noted that slots 71*b* are in parallel with each other and line 71*f* which is a plane running in parallel with opposed edges of plate 51*b*, line 71*f* defining the direction of movement of the plates upon expansion and contraction of precipitators 1 and 2.

In the description of the connection assembly 51, it is realized that all intermediate connection assemblies including connection assemblies 151, 251, 57, 157 and 257, which are shown, as well as those that are not shown, are identical in structure thereby permitting longitudinal and transversal expansion and contraction of the precipitators 1, 2, 3 and 4. Therefore, further discussion of the aforementioned connection assemblies in detail will not be made.

It is also shown that horizontally extending support members 30, 31 and 37 are welded at one end to member 11 and attached at their opposed end to vertically extending members 10 and 12 (FIG. 2) and a vertically extending intermediate member disposed in the vertical column directly beneath support member 314 (FIG. 2) and in the same plane as members 10, 11 and 12. As discussed previously, the horizontal support structure of base support system 6 and intermediate support system 8 maintain the vertical extending members in the system stationary.

In the support system 8, as shown in FIGS. 1 and 3, cross-members 224 are also provided to brace the vertical extending members 210–218.

Generally, the housings of the electrostatic precipitators 1, 2, 3 and 4 are made from thin plates of sheet metal so the vertical extending columns pass through the housings to add support thereto. In FIG. 1 a cutaway of one corner of precipitator 4 is shown with the vertical extending member 312 passing therethrough and welded thereto to add support as discussed previously, it being realized that the other vertically extending members also pass through and are welded thereto.

In the operation of the electrostatic precipitators 1, 2, 3 and 4, for hot gases, as the hot gases pass through the precipitators, the structural components therein heat up and expand. As the precipitators expand, the connection assemblies in the intermediate and corner vertical columns allow the vertical members to move in a horizontal direction as defined by the slots of the connection assemblies. As best seen in FIG. 2, the expanding connection assemblies allow movement along the lines noted by the arrows which is the directions the electrostatic precipitators move upon expansion and contraction. Also, it can be appreciated that because of the horizontal support systems 6 and 8 discussed previously, the vertical columns in these systems do not move upon expansion and contraction movement of the precipitators, and only the vertical members in the same plane as the precipitators move horizontally in the directions discussed above.

It will be realized that various changes may be made to the specific embodiment shown and described without departing from the scope and principles of the present invention.

What is claimed is:

1. A multi-storied electrostatic precipitator comprising:

a base support including a vertically extending member at each corner;

a first electrostatic precipitator including a vertically extending member at each corner in alignment with and movably fastened to a respective one of said vertically extending members of said base support to provide pairs of vertically extending members with first horizontal sliding means disposed therebetween, said first horizontal sliding means including a connection assembly connecting each pair of aligned vertically extending members, said connection assembly including a pair of plate members, one plate member being attached on one face to said vertically extending member of said first electrostatic precipitator, the other plate member being attached on one face to said vertically extending member of said base support with a sliding connection assembly disposed therebetween, said sliding connection assembly including a first slide pad attached to an opposed face of said one plate member and a second slide pad attached to an opposed face of said other plate member, said first slide pad and said one plate member having aligned elongated slots therein in parallel alignment with a plane passing through the center of said multi-storied electrostatic precipitator and the corner of said first electrostatic precipitator to which said connection assembly is disposed, said second slide pad and said other plate member having aligned openings therein in vertical alignment with said elongated slots, and bolt means passing through said aligned slots and openings whereby said first electrostatic precipitator is freely movable for a distance defined by the length of said elongated slots;

an intermediate support mounted onto said first electrostatic precipitator with second horizontal sliding means disposed therebetween; and, a second electrostatic precipitator mounted onto said intermediate support with third horizontal sliding means disposed therebetween whereby said first and second electrostatic precipitators are movable in a horizontal direction independent of each other.

2. A multi-storied electrostatic precipitator comprising:

a base support including a vertically extending member along an edge thereof;

a first electrostatic precipitator including a vertically extending member along an edge thereof equidistant from each end of said first precipitator in alignment and movably fastened to said vertically extending member of said base support with first horizontal sliding means disposed therebetween, said first horizontal sliding means including a connection assembly connecting said aligned vertically extending members, said connection assembly including a pair of plate members, one plate member being attached on one face to said vertically extending member of said first electrostatic precipitator, the other plate member being attached on one face to said vertically extending member of said base support with a sliding connection assembly disposed therebetween, said sliding connection assembly including a first slide pad attached to an opposed face of said one plate member and a second slide pad attached to an opposed face of said other plate member, said first slide pad and said one plate member having aligned elongated slots therein in alignment with a plane running from said aligned slots therein to the center of said multi-storied electrostatic precipitator, said second slide pad and said other plate member having aligned bolt receiving openings therein in vertical alignment with said elongated slots, and, bolt means passing through said aligned slots and openings whereby said electrostatic precipitator is freely movable for a distance defined by the length of said elongated slots;

an intermediate support mounted onto said first electrostatic precipitator with second horizontal sliding means disposed therebetween; and, a second electrostatic precipitator mounted onto said intermediate support with third horizontal sliding means disposed therebetween whereby said first and second electrostatic precipitators are movable in a horizontal direction independent of each other.

* * * * *